US008011017B2

(12) United States Patent
Andrews

(10) Patent No.: US 8,011,017 B2
(45) Date of Patent: Sep. 6, 2011

(54) WETSUIT NECK AND ARM PROTECTIVE MEMBERS

(75) Inventor: Ryan Scott Andrews, Swampscott, MA (US)

(73) Assignee: Andrews Water Sports, LLC, Swampscott, MA (US)

( * ) Notice: Subject to any disclaimer, the term of this patent is extended or adjusted under 35 U.S.C. 154(b) by 153 days.

(21) Appl. No.: 12/458,310

(22) Filed: Jul. 8, 2009

(65) Prior Publication Data

US 2010/0005576 A1 Jan. 14, 2010

Related U.S. Application Data

(60) Provisional application No. 61/129,696, filed on Jul. 14, 2008.

(51) Int. Cl.
*B63C 11/04* (2006.01)
*B63C 11/00* (2006.01)

(52) U.S. Cl. ..... 2/2.16; 2/2.15; 2/2.17

(58) Field of Classification Search ..... 2/2.15, 2/2.16, 2.17

See application file for complete search history.

(56) References Cited

U.S. PATENT DOCUMENTS

| | | | | | |
|---|---|---|---|---|---|
| 1,706,097 | A * | 3/1929 | Aud | 441/103 |
| 3,493,972 | A * | 2/1970 | Oldham | 2/2.17 |
| 3,958,275 | A | 5/1976 | Morgan et al. | |
| 4,438,531 | A * | 3/1984 | Long et al. | 2/2.15 |
| 4,809,364 | A * | 3/1989 | Lent | 2/2.15 |
| 4,862,517 | A * | 9/1989 | Meistrell | 2/2.17 |
| 5,603,116 | A * | 2/1997 | Tronc | 2/2.15 |
| 5,630,229 | A * | 5/1997 | Machado et al. | 2/2.15 |
| 5,647,059 | A * | 7/1997 | Uglene et al. | 2/2.15 |
| 5,752,278 | A * | 5/1998 | Gunn | 2/69 |
| 5,896,578 | A * | 4/1999 | Hunter et al. | 2/2.15 |
| 5,898,934 | A * | 5/1999 | Hunter et al. | 2/2.15 |
| 6,143,368 | A * | 11/2000 | Gunn | 427/407.1 |
| 6,665,882 | B1 | 12/2003 | Pedrick | |
| 6,789,270 | B1 | 9/2004 | Pedrick | |
| 6,874,170 | B1 | 4/2005 | Aaron | |
| 6,886,182 | B2 | 5/2005 | Saillet et al. | |
| 7,096,506 | B2 * | 8/2006 | Ragot | 2/2.15 |
| 7,189,128 | B2 | 3/2007 | Halliday | |
| 2002/0108160 | A1 * | 8/2002 | Griffiths | 2/2.15 |

(Continued)

FOREIGN PATENT DOCUMENTS

DE 3542323 11/1985

*Primary Examiner* — Bobby Muromoto, Jr.
(74) *Attorney, Agent, or Firm* — Michael de Angeli

(57) ABSTRACT

A neck-protective member for preventing chafe encountered when wearing a wetsuit is provided that fits snugly around the wearer's neck, with its lower edge under the edge of the neck opening in the wetsuit. The edge of the neck opening in the wetsuit bears against the protective member rather than the skin of the wearer's neck, preventing painful chafing that can be experienced around a wearer's neck upon prolonged wetsuit use.

In a particularly preferred embodiment of the invention, the neck-protective member of the invention comprises a generally conical neck portion, which fits around the wearer's neck, and a skirt portion, which fits over the wearer's shoulders, under the wetsuit. The neck portion may be formed of a single band-like member cut from a sheet of flat material, preferably "smoothskin" neoprene rubber material, oriented such that the smooth surface of the "smoothskin" neoprene rubber material is to the inside and contacts the wearer's neck. Similar members can also be provided for prevention of chafe between the ends of sleeves in the garment and the arms of the wearer.

3 Claims, 1 Drawing Sheet

U.S. PATENT DOCUMENTS

2005/0166303 A1 8/2005 Aaron
2006/0260018 A1* 11/2006 Gordon et al. ..... 2/2.5
2007/0277277 A1* 12/2007 Moore ..... 2/2.15
2008/0008597 A1* 1/2008 Dannemiller et al. ..... 416/70 R
2010/0041943 A1* 2/2010 Hovland et al. ..... 600/38

* cited by examiner

WETSUIT NECK AND ARM PROTECTIVE MEMBERS

CROSS-REFERENCE TO RELATED APPLICATION

This application claims priority from U.S. Provisional Patent Application Ser. No. 61/129,696, filed Jul. 14, 2008.

FIELD OF THE INVENTION

The present invention relates to protective members to be worn by surfers and other persons wearing wetsuits in order to prevent painful chafing.

BACKGROUND OF THE INVENTION

Wetsuits, that is, closely-fitting suits of "Neoprene" rubber or like materials, are commonly worn by surfers, kayakers, divers, swimmers, and others whose chosen activities require long-term immersion in or exposure to water, both salt and fresh. In this application reference is made to "surfers" or other wearers, for simplicity, but all classes of persons wearing wetsuits are intended to be included therein. To the extent similar problems may occur with other tight-fitting garments, such as drysuits, the invention is applicable thereto as well.

The typical wetsuit comprises a form-fitting suit that covers the torso and at least the upper arms and legs of the wearer. The typical material of the wetsuit is a polychloroprene or "neoprene" closed-cell foam layer backed on at least its outer surface with a fabric layer for strength; typical materials for the fabric layer are synthetics such as those known in the art as Nylon, Lycra or Spandex. In use, a layer of water is confined between the wearer's skin and the foam inner layer, and is warmed by the user's body heat, providing an insulative layer. Commonly, a slide fastener is provided running up the back of the wetsuit, along the wearer's spine, from a closed end in the region of the waist to an open termination at the neck opening, to enable the wetsuit to be donned and later removed. Typically a collar portion of the wetsuit extends partially up the neck of the wearer. The slide fastener then terminates at the upper edge of the neck opening. A flap is sometimes provided that extends from one side of the upper back across the slide fastener to the other side, and is secured with hook-and-loop material.

Another type of wetsuit is the "step in" type, wherein the wearer stretches out the neck opening and pulls the suit over his or her body to don it.

The material of the wetsuit is usually rather stiff and tight-fitting, such that the neck opening terminates at a relatively hard edge, the flexibility of which is further limited by the upper termination of the slide fastener, if used, and by the flap, if provided. As the wearer moves, the edge of the neck opening, particularly in the region of the upper termination of the slide fastener, if provided, tends to chafe his or her skin. This chafing can be very painful, and typically takes some days to heal, preventing comfortable wearing of the wetsuit for more than one or a very few days in succession. Similar chafing tends to occur at the ends of the arm openings of the wetsuit, especially where the wetsuit is of the short-sleeved "spring" type, where the arm portions end at the biceps. Again, the skin of the wearer tends to be painfully chafed by the edge of the opening in the wetsuit, which has to fit tightly to limit incursion of water.

The prior art has recognized this problem, at least inferentially. For example, U.S. Pat. No. 7,096,506 to Ragot shows a design for a wetsuit comprising an internal collar which would appear to provide some protection against chafing in the neck area against the edge of the neck opening of the wetsuit, although this does not appear to have been mentioned specifically. However, Ragot's neck collar is to be fixed to an internal surface of the wetsuit; as an integral part of the wetsuit, Ragot's collar is not suitable for use with pre-existing wetsuits. It would be desirable to provide a chafe-preventing collar that could be used with pre-existing wetsuits, so that a surfer or other user could enjoy the benefits of a chafe-preventing collar without having to incur the expense of purchasing a new wetsuit having this feature.

Likewise, the O'Neill company offers a "Mutant" model wetsuit that includes a collar that is meant to be zipped to the wetsuit, again to reduce chafing. Again, this is only suitable for use with the corresponding wetsuit and does not address the needs of those who already own wetsuits.

OBJECTS OF THE INVENTION

Accordingly, the purpose of the invention is to provide protective members that are suitable for use with preexisting wetsuits and similar garments and which will substantially limit or completely prevent the chafing that tends to occur on the neck and arms of a wearer due to friction occasioned by normal motions when wearing a conventional wetsuit.

SUMMARY OF THE INVENTION

According to a first aspect of the invention, a neck-protective member is provided that fits snugly around the wearer's neck, with its lower edge and a substantial portion of its width under the edge of the neck opening in the wetsuit and its upper edge protruding from the neck opening. Thus, the edge of the neck opening in the wetsuit bears against the protective member rather than the skin of the wearer's neck. Accordingly, this protective member prevents the painful chafing that occurs around the neck from prolonged wetsuit use.

In a particularly preferred embodiment of the invention, the neck-protective member of the invention comprises a generally conical neck portion, which fits around the wearer's neck, and a skirt portion, which fits over the wearer's shoulders, under the wetsuit, so that the uppermost section of the neck portion protrudes from the neck aperture in the wetsuit. The neck portion may be formed of a single band-like member cut from a sheet of flat material, the ends of which are sewn and/or glued to another to make up the complete neck portion; preferably the ends of the band are cut so as to meet on a bias, so that the seam does not run directly up the wearer's neck. The band member making up the neck portion preferably comprises "smoothskin" neoprene, oriented such that the smooth surface of the "smoothskin" material is to the inside and contacts the wearer's neck. The skirt portion can be formed of two members cut from flat conventional neoprene, sewn and/or glued to one another and to the neck portion to make up the complete neck-protective member.

It is found, at least in initial testing, that provision of the "smoothskin" material for the neck portion but not for the skirt portion of the neck-protective member of the invention provides substantial advantages. Specifically, the "smoothskin" material when wet tends to be adhered to the skin of the wearer's neck, holding the neck-protective member in place, preventing chafe from the edge of the wetsuit. If the entire neck-protective member is made of the "smoothskin" material, including the skirt portion, it appears in initial testing to be too restrictive, in that the skirt portion also adheres to the wearer's shoulders; if the "smoothskin" material is not used for the neck portion, the neck-protective member tends not to be retained where desired and fails to prevent chafing.

Similarly, according to a further aspect of the invention, a generally band-shaped arm-protective member is provided that is worn at the ends of the sleeves of wetsuits, fitting snugly under the cuffs at the end of the sleeves. Again, the edge of the cuff at the end of the sleeve bears against the band-like arm-protective member, instead of the skin of the wearer's arm, limiting chafing due to friction. The inside of the cuff can also be made of "smoothskin" neoprene.

Both neck- and arm-protective members are preferably made from neoprene or trilastic neoprene (which are common materials for wetsuits) to allow for mobility, comfort and stretch. More specifically, these members are made of materials sold as "neoprene" rubber but which in fact comprise a layer of neoprene foam backed by a fabric layer, as discussed above. In each case they need to fit snugly between the edge of the corresponding opening in the wetsuit and the skin of the wearer, to reduce water incursion, and so that they do not move out of their preferred positions due to motion of the wearer. As noted, different portions of the protective members may desirably be formed of different materials. Both neck- and arm-protective members may be shaped or fitted with attachment devices to ensure that they are securely retained in their desired positions. To ensure proper fit, both neck- and arm-protective members will be provided in various sizes to accommodate different wearers.

BRIEF DESCRIPTION OF THE DRAWINGS

The invention will be better understood if reference is made to the accompanying drawings, in which.

DESCRIPTION OF THE PREFERRED EMBODIMENTS

Figure 1:
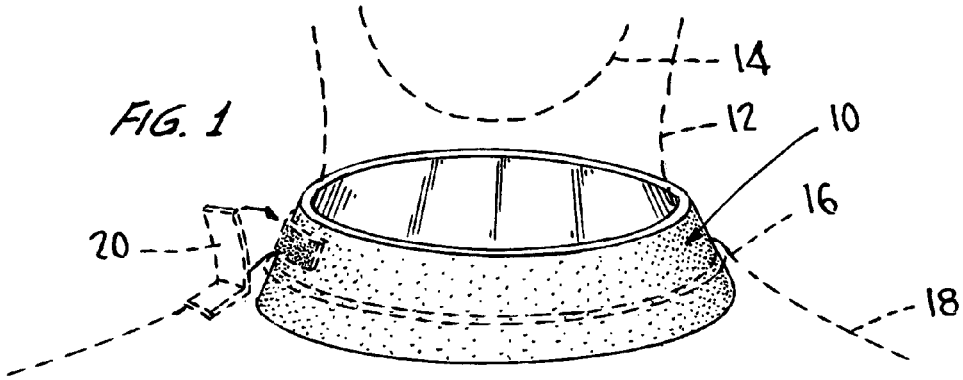
FIG. 1 shows a perspective view of a first embodiment of the neck-protective member of the invention, with the wearer's neck and a portion of the wetsuit shown in dashed lines.

As mentioned above, FIG. 1 shows a first embodiment of the neck-protective member of the invention. In this embodiment, the neck-protective member 10 is a continuous band of neoprene, which may comprise the "smoothskin" neoprene rubber material, with the smooth surface disposed to the inside. Typically member 10 will be formed by cutting a strip of suitable material and sewing and gluing its ends together, preferably using the seam detail discussed below in connection with FIG. 5. In this embodiment, the member is stretched so as to be pulled over the head and neck 14 of the wearer and is sized to fit snugly around the wearer's neck 12. Typically, the band of neoprene will be 2-6 inches wide and of a circumference to fit the neck of the wearer snugly. It may comprise a generally conical shape, as shown, so as to fit over the wearer's neck, or may be shaped so as to extend downwardly, e.g. partially over the wearer's back, shoulders, and chest. Internally it should have a smooth surface so there is no skin irritation.

As illustrated, the member 10 is situated so that the edge 16 of the neck opening of the wetsuit 18 bears approximately in the center of the member 10. This will prevent neck chafing. As illustrated, the member 10 can be affixed temporarily to the wetsuit 18 by cooperating strips of hook-and-loop fasteners 20; these could be sold together with the member 10 so as to enable a wearer to retrofit a preexisting wetsuit with the member according to the invention, and thereby prevent chafing.

Figure 2:
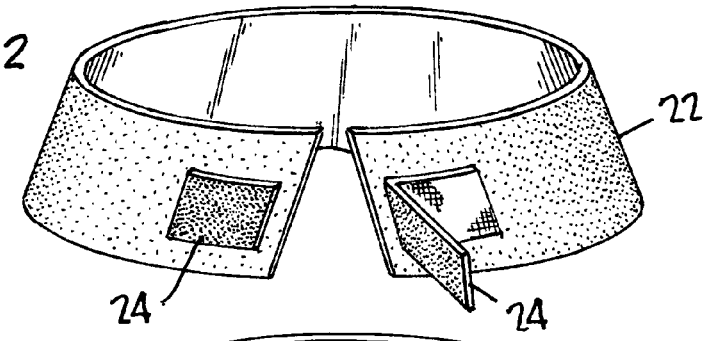
FIG. 2 shows a similar view of a second embodiment of the neck-protective member of the invention.

FIG. 2 shows a second embodiment of the neck-protective member of the invention, wherein the member 22 is provided as a discontinuous neoprene strip, typically 2-6 inches wide and 10-22 inches long, to suit the neck of the wearer. Cooperating hook-and-loop fasteners 24 are used to attach one end of the strip to the other. In order not to disrupt the smoothness of the internal part of the collar, the hook-and-loop fasteners 24 should be provided as small patches approximately 2½ inches wide and 3 inches long, and should be mounted about ½ inch away from the ends of the guard. Again, the member 22 is worn under the wetsuit, wrapped around the neck so that the edge of the neck aperture in the wetsuit lies on the member 22, preventing neck chafing. Again, the member 22 can be shaped so as to fit principally around only the wearer's neck, or may be shaped so as to extend downwardly, e.g. partially over the wearer's back, shoulders, and chest. As in the case of the FIG. 1 embodiment, further cooperating hook-and-loop strips (not shown) can be employed to secure the member 22 in a desired position with respect to the neck opening of the wetsuit. Where the member 22 is intended for retrofitting to prexisting wetsuits, it may be sold with suitable strips of the hook-and-loop material.

Figure 3:
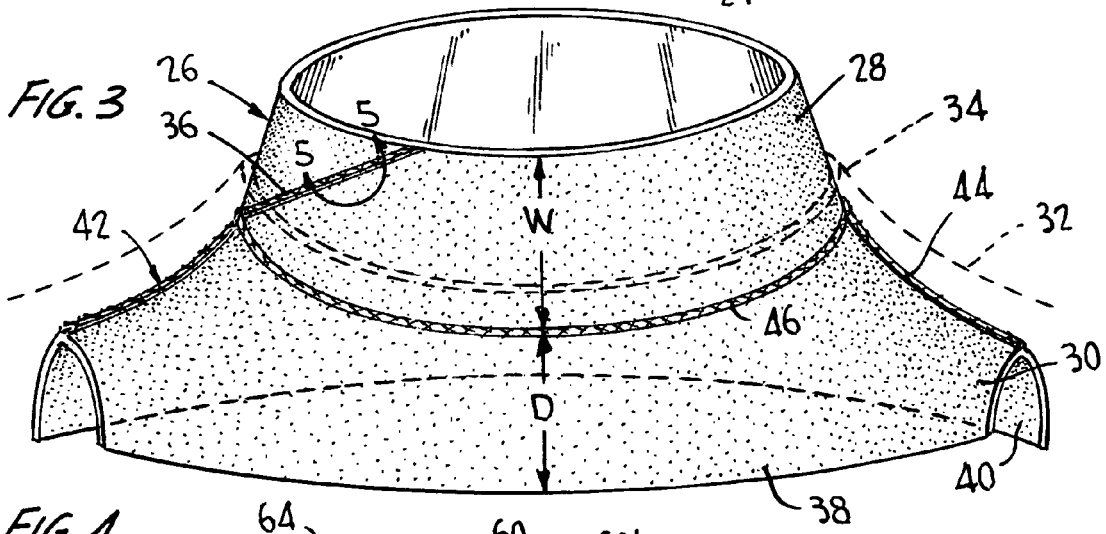
FIG. 3 shows a similar view of a third embodiment of the neck-protective member of the invention, again with the wearer's neck and a portion of the wetsuit shown in dashed lines.

FIG. 3 shows a third embodiment of the neck-protective member 26 of the invention, which is currently preferred. In this embodiment, the neck-protective member 26 comprises a continuous neck-surrounding band portion 28, sized to fit snugly, so that it must be stretched so as to be pulled over the head of the wearer, both as in the FIG. 1 embodiment, but also comprises a skirt portion 30 attached to the bottom of the neck-surrounding band portion 28. The skirt portion extends well underneath the shoulder portion of the wetsuit 32, partially covering the back, shoulders, and chest of the wearer, so that the neck-surrounding band portion 28 protrudes from the neck aperture 34 in the wetsuit 32, preventing chafe of the wearer's neck against the edge of the neck aperture 34 in the wetsuit 32.

More particularly, and as indicated above, in this preferred embodiment the neck-protective member of the invention 26 comprises a generally conical neck-surrounding band portion 28, which fits around the wearer's neck, and a skirt portion 30, which fits over the wearer's shoulders, under the wetsuit. The neck portion 28 is preferably formed of a single band-like member cut from a sheet of flat material, the ends of which are sewn and/or glued to another to make up the complete neck portion; preferably the ends of the band are cut so as to meet on a bias, as illustrated, so that the seam 36 does not run directly up the wearer's neck, reducing chafe.

Figure 5:
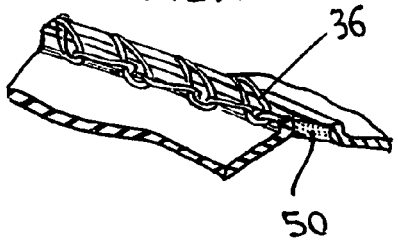
FIG. 5 shows a cross-sectional view taken along line 5-5 in FIG. 3, showing a detail of the preferred seam construction.

As illustrated by FIG. 5, preferably this seam 36 and other seams used to fabricate the neck-protective member of the invention are implemented using a stitch known in the art as a single blind stitch, extending about halfway through the thickness of the neoprene, and are glued as well using a bead 50 of conventional glue, e.g., Stabond #0836 sold by Sta Bond of Gardena, Calif. The opposed edges of the band that are sewn together to form seam 36 are disposed to the outside so that the seam 36 does not itself tend to chafe the skin of the wearer.

As mentioned above, in the preferred embodiment, the band-like member making up the neck-surrounding band portion 28 preferably comprises "smoothskin" neoprene rubber material. This material is well-known in the art, and comprises a layer of neoprene rubber (again, a layer of neoprene foam with a fabric backing) having a shiny, relatively non-porous surface on one side. More specifically, it is generally understood by the inventor that this smooth surface is formed by heat and pressure applied to one surface of a conventional sheet of neoprene; suitable "smoothskin" material is sold by the Sheico Company (Shei Chung Hsin Industrial Co., Ltd, of Taiwan, ROC) as Sheico Internal Smooth Skin Neoprene. The "smoothskin" material of the neck portion 28 is oriented such that the smooth surface of the "smoothskin" material is to the inside and contacts the wearer's neck. The skirt portion in the FIG. 3 embodiment can be formed of two members 38 and 40 cut from flat conventional neoprene (that is, not "smoothskin" material), such as Sheico Double Sided Nylon Neoprene, sewn and glued to one another at seams 42 and 44 and to the neck portion at seam 46 to make up the complete neck-protective member.

It is found that provision of the "smoothskin" material for the neck portion 28 only, as described, provides substantial advantages. Specifically, the "smoothskin" material when wet tends to be adhered to the skin of the wearer's neck, holding the neck-protective member 26 in place, preventing chafe from the edge of the wetsuit. If the entire neck-protective member 26 is made of the "smoothskin" material, including the skirt portion, it may be found too restrictive, in that the skirt portion 30 also tends to adhere to the wearer's shoulders; if the "smoothskin" material is not used for the neck portion 28, the neck-protective member 26 of the invention tends not to be retained where desired.

The dimensions of the preferred embodiment of the neck-protective member 26 of the invention can vary substantially within the scope of the invention. Typically the width W of the neck portion 28 will be on the order of 2 -½ inches and the depth D of the skirt portion 30 about 2 inches; the length of the seams 42 and 44 is also on the order of 2 inches. The neck portion 28 and the skirt portion 30 can both be made of material 2 mm thick, but as noted this and the other dimensions mentioned can vary widely without departure from the scope of the invention.

Figure 4:
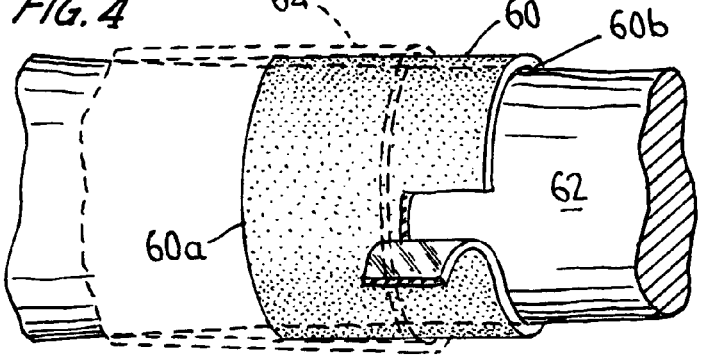
FIG. 4 shows a similar view of the arm-protective member of the invention, with a portion of the wearer's arm and wetsuit shown in dashed lines.

Finally, FIG. 4 shows an arm-protective guard 60. As in the FIG. 1 neck-protective guard, this is a continuous strip of neoprene or similar material two to six inches wide and of a circumference to suit the wearer, in the bicep or wrist area 62 of the wearer's arms. The material employed may be "smoothskin" neoprene rubber material, as discussed above, with the smooth surface to the inside. It is worn so that its proximal edge 60*a* fits under the end of the sleeve portion 64 of the wetsuit, and so that its distal portion 60*b* protrudes from the sleeve 64 for chafe protection. Hook-and-loop fasteners (not shown), generally as in FIG. 1, may be provided to secure the guard 60 in place with respect to the sleeve portion 64 of the wetsuit.

While several preferred embodiments of the invention have been described in detail, the invention is not to be limited thereto, but only by the following claims.

What is claimed is:

1. A neck-protective member for being worn by a wearer around the wearer's neck to reduce chafe from the neck aperture of a wetsuit or similar garment, comprising:

a neck band portion cut from a flat sheet of a polychloroprene rubber material having a smooth, low friction surface, shaped to conform to the wearer's neck when the ends of the band member are joined to another, forming a seam, with said smooth, low friction surface in contact with the wearer's neck when worn, so as to be adhered to the wearer's skin when wet and keep the neck-protective member in place, and a skirt portion comprising two members cut from a flat sheet of polychloroprene rubber material having a high friction surface and joined to one another and to said neck band portion at seams, such that said high friction surface is in contact with the wearer's shoulders and is not adhered thereto, whereby in use said neck band portion fits around the wearer's neck and said skirt portion fits over the wearer's shoulders, such that said neck band portion protrudes from the neck aperture of the garment, preventing chafe.

2. The neck-protective member of claim 1, wherein said seams are formed using a single blind stitch and are also glued.

3. The neck-protective member of claim 1, wherein said seam in the neck band portion is formed on a bias, not directly transverse to the width of said band portion.

* * * * *